US008063842B2

(12) United States Patent
Kurashima et al.

(10) Patent No.: US 8,063,842 B2
(45) Date of Patent: Nov. 22, 2011

(54) ANTENNA APPARATUS

(75) Inventors: Shigemi Kurashima, Shinagawa (JP); Masahiro Yanagi, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 379 days.

(21) Appl. No.: 12/509,518

(22) Filed: Jul. 27, 2009

(65) Prior Publication Data

US 2010/0066611 A1 Mar. 18, 2010

(30) Foreign Application Priority Data

Sep. 12, 2008 (JP) ..... 2008-235021

(51) Int. Cl.
*H01Q 13/10* (2006.01)

(52) U.S. Cl. ..... 343/773; 343/848

(58) Field of Classification Search ..... 343/700 MS, 343/773, 846, 848
See application file for complete search history.

(56) References Cited

U.S. PATENT DOCUMENTS

| | | | | |
|---|---|---|---|---|
| 7,027,002 | B2 * | 4/2006 | Suh et al. | 343/773 |
| 7,796,087 | B2 * | 9/2010 | Yanagi et al. | 343/702 |
| 2006/0187134 | A1 * | 8/2006 | Hoshi | 343/773 |
| 2008/0018538 | A1 * | 1/2008 | Kushihi | 343/700 MS |
| 2010/0053017 | A1 * | 3/2010 | Kurashima et al. | 343/848 |
| 2010/0066632 | A1 * | 3/2010 | Kurashima et al. | 343/878 |

FOREIGN PATENT DOCUMENTS

JP 2004-129209 4/2004

* cited by examiner

*Primary Examiner* — Tan Ho
(74) *Attorney, Agent, or Firm* — IPUSA, PLLC

(57) ABSTRACT

An antenna apparatus is disclosed that includes an antenna element having a teardrop shape and configured to be fed with electrical power from an external power source; and a ground element coupled to the antenna element, wherein the antenna element includes one or more nonconductive portions.

7 Claims, 5 Drawing Sheets

ANTENNA APPARATUS

BACKGROUND OF THE INVENTION

1. Field of the Invention

The present invention relates to an antenna apparatus used in Ultra Wide Band (UWB) communication.

2. Description of the Related Art

UWB communication enables an ultra fast communication by using a GHz frequency band. In 2002, the U.S. Federal Communication Commission (FCC) approved usage of the UWB. Since then, an application of the UWB to a portable electronic device and a high precision positioning system has been expected. An ultra wide frequency band antenna apparatus, which includes a teardrop-shaped antenna element and is suitable for a GHz frequency band, has been developed.

Patent Document 1: Japanese Patent Laid-Open Publication No. 2004-129209

A conventional antenna apparatus which includes the teardrop-shaped antenna element provides uniform directivity in 360 degrees, because the antenna element has a uniform shape in planar view.

However, in a case where a communication device with which the antenna apparatus communicates is settled and the direction or the location of the communication device is known, the uniform characteristics in 360 degrees may not be required. In such a case, the conventional antenna apparatus which provides the uniform directivity in 360 degrees may be influenced by noise from a noise source located in a direction which is not necessary for a UWB communication, or may cause noise in an electronic device which does not communicate with the conventional antenna apparatus.

Although it is a technical feature of an antenna apparatus which includes an antenna element having a teardrop shape to provide uniform directivity in 360 degrees, the antenna apparatus can be used more widely if the antenna apparatus selects communication direction.

SUMMARY OF THE INVENTION

It is a general object of the present invention to provide an antenna apparatus which includes an antenna element having a teardrop shape and provides selectivity of communication direction.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an antenna apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an antenna apparatus including an antenna element having a teardrop shape and configured to be fed with electrical power from an external power source; and a ground element coupled to the antenna element, wherein the antenna element includes one or more nonconductive portions.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 1:
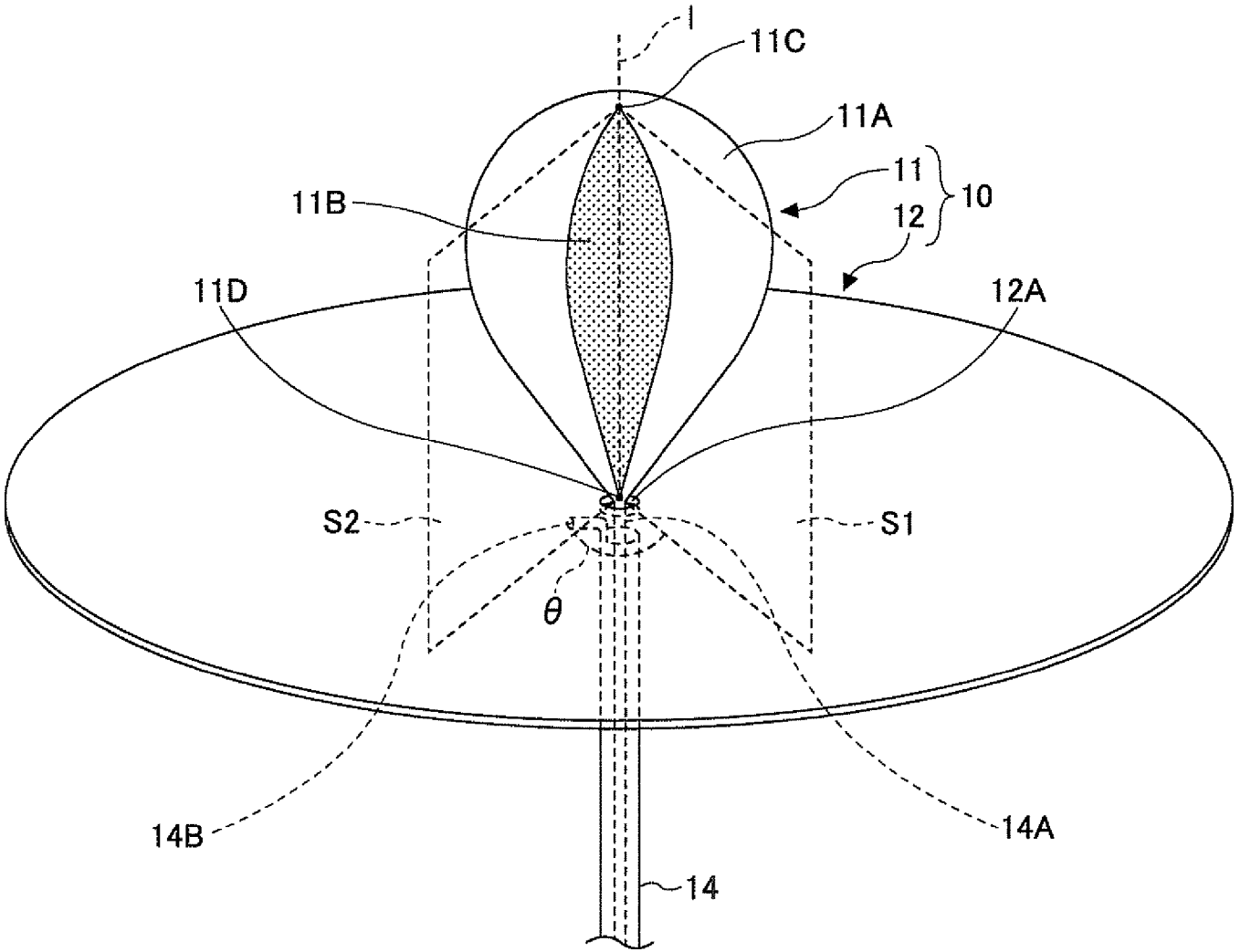
FIG. 1 is a schematic drawing of an antenna apparatus according to first embodiment shown in perspective view.

FIG. 1 is a schematic drawing of an antenna apparatus according to a first embodiment shown in perspective view.

As shown in FIG. 1, an antenna apparatus 10 includes an antenna element 11 having an inverted teardrop shape, and a ground element 12 having a disc shape.

The antenna element 11 is formed of a metal-plated, inverted-teardrop-shaped resin which is formed by plating a metal on a molded inverted teardrop-shaped resin. The antenna element 11 includes a metal layer 11A and a nonconductive portion 11B. The metal layer 11A is formed on a part of the surface of the inverted teardrop-shaped resin. The rest of the surface on which the metal layer 11A is not formed becomes the nonconductive portion 11B. The inverted teardrop-shaped resin may be made from, for example, a resin such as ABS (Acrylonitrile Butadiene Styrene), PC (Polycarbonate), or PS (Polystyrene). The metal layer 11A may be made from, for example, chromium, aluminum, or nickel.

The inverted teardrop shape of the antenna element 11 may be formed by engaging a hemispherical shape and a conical shape so that the hemispherical shape and the conical shape form a continuous outer surface of the inverted teardrop shape.

The nonconductive portion 11B is a part of the surface of the inverted teardrop-shaped resin, and is formed in an area bounded by two virtual planes S1 and S2 which include a central axis 1 of the inverted teardrop shape and intersect at an angle $\theta$.

The nonconductive portion 11B is formed, for example, by a mask process when the molded inverted teardrop-shaped resin is metal plated.

The antenna element 11 includes a top portion 11C (a top portion of the hemispherical shape) which becomes a null point of the antenna element 11, and a feeding portion 11D which is formed at an apex of the conical shape. A cable core 14A of a coaxial cable 14 is connected to the feeding portion 11D in order to feed electrical power thereto from an external power source.

The antenna element 11 is a quarter wavelength high from the upper surface of the ground element 12 to the top portion 11C when assembled to the ground element 12. The quarter wavelength is determined by a communication frequency, and becomes, for example, about 25 centimeters if the communication frequency is 3 GHz.

The ground element 12 includes an opening 12A through which the cable core 14A of the coaxial cable 14 is connected to the feeding portion 11D in order to feed electrical power to the feeding portion 11D. A shielded line 14B of the coaxial cable 14 is connected to the back surface of the ground element 12. Thus, in the illustrated embodiment, the electrical potential of the ground element 12 is kept to the ground potential.

Although the ground element 12 in FIG. 1 is shown as having a disc shape, the ground element 12 may be shaped in any shape in planar view, and the ground element 12 may be shaped to have any thickness.

The coaxial cable 14 may be formed of a shielded coaxial cable of which the characteristic impedance is 50Ω.

The antenna element 11 is insulated from the ground element 12, and is connected to the ground element 12.

Figure 2A:
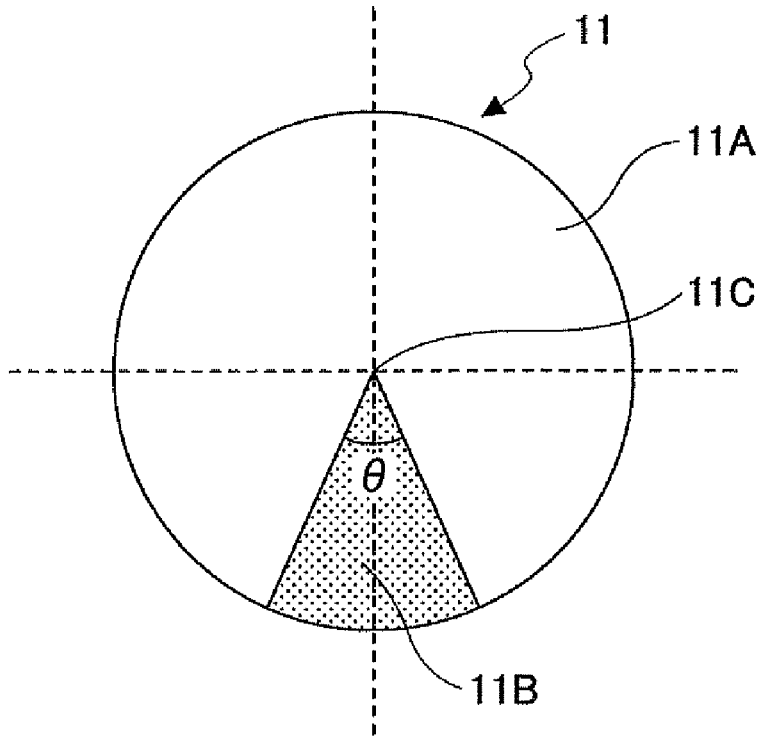
FIG. 2A is a schematic drawing of an antenna element according to the first embodiment shown in planar view.
Figure 2B:
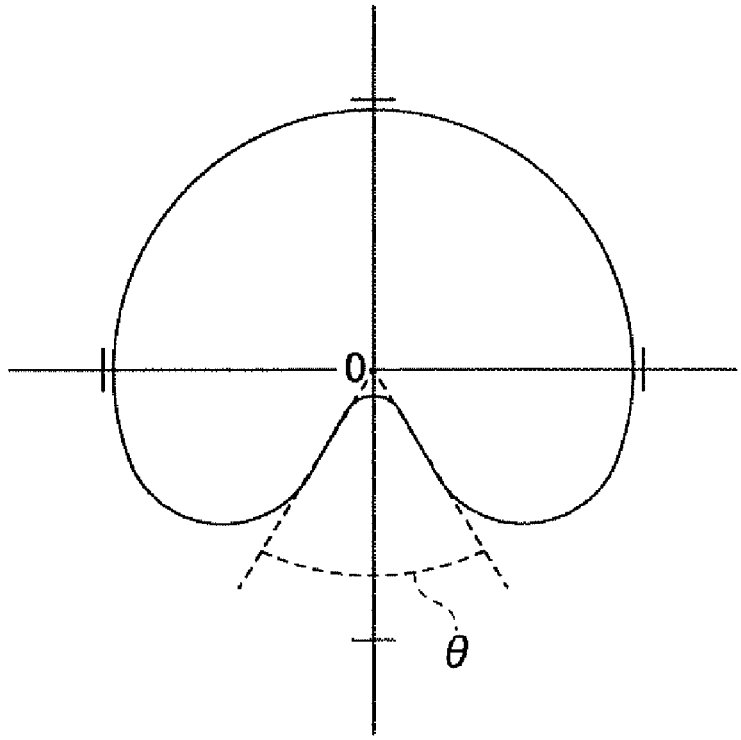
FIG. 2B is a graph showing directivity of the antenna apparatus according to the first embodiment.

FIG. 2A is a schematic drawing of the antenna element 11 according to the first embodiment shown in planar view. FIG. 2B is a graph showing directivity of the antenna apparatus according to the first embodiment.

As shown in FIG. 2A, the nonconductive portion 11B is located in an area defined by the central angle θ in the circle of the antenna element 11 in planar view. As described above, the angle θ is formed by two virtual planes S1, S2 which include the central axis 1 (shown in FIG. 1). The antenna element 11 does not radiate an electrical wave and does not receive an electrical wave in a direction included in the angle θ in planar view.

Referring to FIGS. 2A and 2B, the directivity is lower in the direction included in the angle θ in which the nonconductive portion 11B is formed. The directivity shown in FIG. 2B is different from those of an antenna element which does not include the nonconductive portion 11B, e.g. a molded shaped resin of which a whole surface is metal plated.

As described above, the antenna apparatus 10 according to the first embodiment provides selectivity of communication direction by forming the nonconductive portion 11B. As shown in FIG. 2B, the antenna apparatus 10 provides an excellent directivity except for the direction in which the nonconductive portion 11B is formed. The electrical wave radiation is lower in the direction in which the nonconductive portion 11B is formed.

The antenna apparatus 10 including the antenna element 11 having the inverted teardrop shape as described above provides a VSWR value of about 2.0 to about 3.0 within the frequency band from about 3.0 to about 20.0 GHz. The antenna apparatus 10 is suitable for UWB communication.

As described above, the antenna apparatus 10 according to first embodiment provides selectivity of communication direction by forming the nonconductive portion 11B. Thus, an influence exerted by the noise source is greatly reduced by facing the nonconductive portion 11B toward a noise source, and the antenna apparatus 10 provides a high quality UWB communication except for the direction in which the nonconductive portion 11B is formed.

In a case where the antenna apparatus 10 is disposed close to a wall, it is better not to radiate an electrical wave toward the wall, because a reflected wave from the wall causes a decrease of sensitivity of the antenna apparatus 10. In this case, it is possible to reduce a reflected wave from the wall and to enhance a sensitivity of the antenna apparatus 10 by facing the nonconductive portion 11B toward the wall.

In a case where there is a direction in which it is better for the antenna apparatus 10 not to radiate an electrical wave, the antenna apparatus 10 provides a high quality UWB communication except for the direction such as a direction toward a wall by forming the nonconductive portion 11B.

The central angle θ of the area in which the nonconductive portion 11B is formed may be set to any value depending on positional relationship between the antenna apparatus 10 and the noise source.

Although the nonconductive portion 11B is formed in an area bounded by two virtual planes S1, S2, which include the central axis 1 connecting the top portion 11C and the feeding portion 11D is shown in FIG. 1, the nonconductive portion 11B may be formed into any shape.

Although the molded inverted teardrop-shaped resin included in the antenna element 11 is described above, the inverted teardrop-shaped resin may be formed by any process except for molding.

Furthermore, although the antenna element 11 described above is formed by plating a metal on a molded teardrop-shaped resin, the antenna element 11 is not limited to this. For example, the antenna element could be formed of any combination of a metal layer and a nonconductive portion, which together form a teardrop-shaped antenna element. The metal layer may comprise other than a metal plating, for example its own sector metal layer. The nonconductive portion may comprise other than a surface of a molded teardrop-shaped resin, for example a sector resin portion.

Second Embodiment

Figure 3:
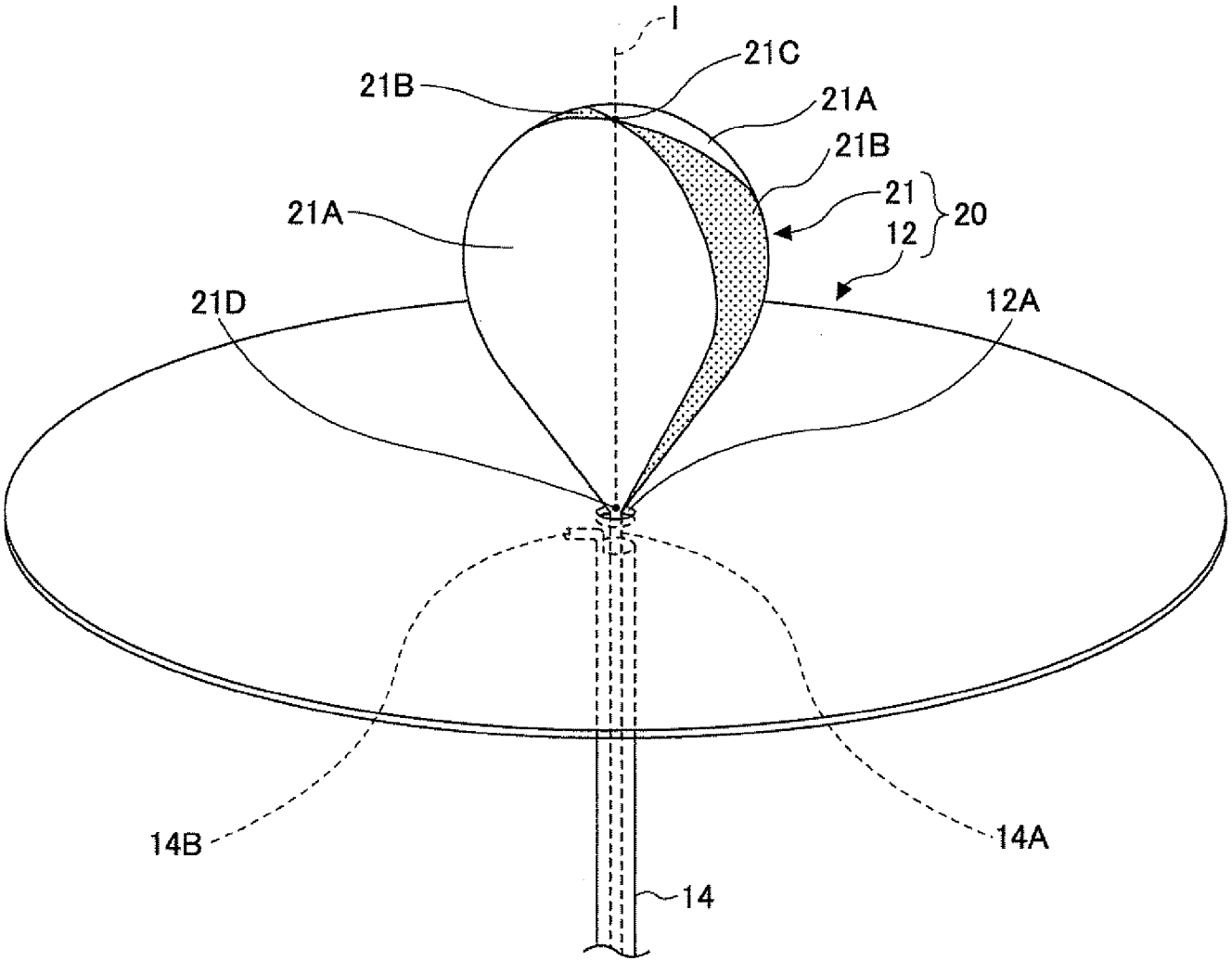
FIG. 3 is a schematic drawing of an antenna apparatus according to second embodiment shown in perspective view.

FIG. 3 is a schematic drawing of an antenna apparatus according to a second embodiment shown in perspective view. Hereinafter, the same elements as or similar elements to those of the antenna apparatus 10 according to the first embodiment are referred to by the same reference numerals, and a description thereof is omitted. An antenna apparatus 20 according to the second embodiment is different from the antenna apparatus 10 according to the first embodiment in that an antenna element 21 of the antenna apparatus 20 includes a pair of metal layers 21A, a pair of nonconductive portions 21B, a top portion 21C, and a feeding point 21D.

Figure 4A:
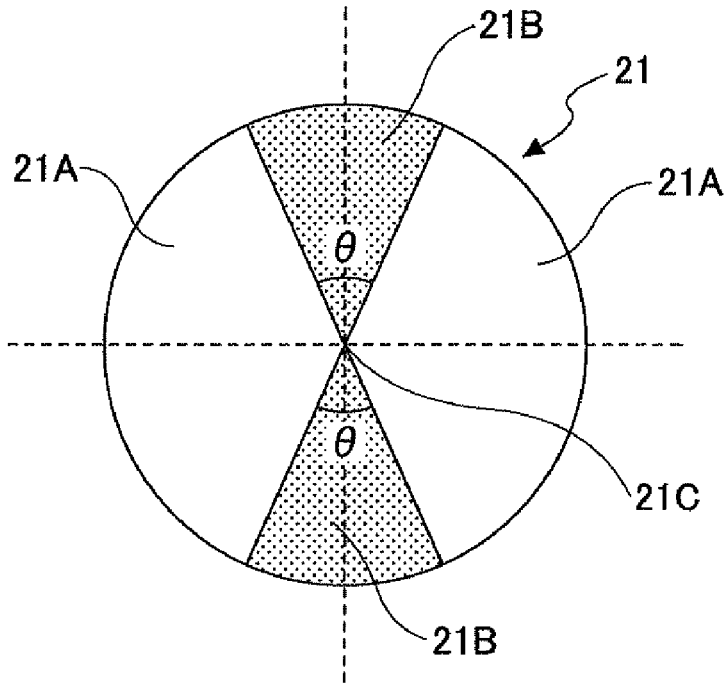
FIG. 4A is a schematic drawing of an antenna element according to the second embodiment shown in planar view.
Figure 4B:
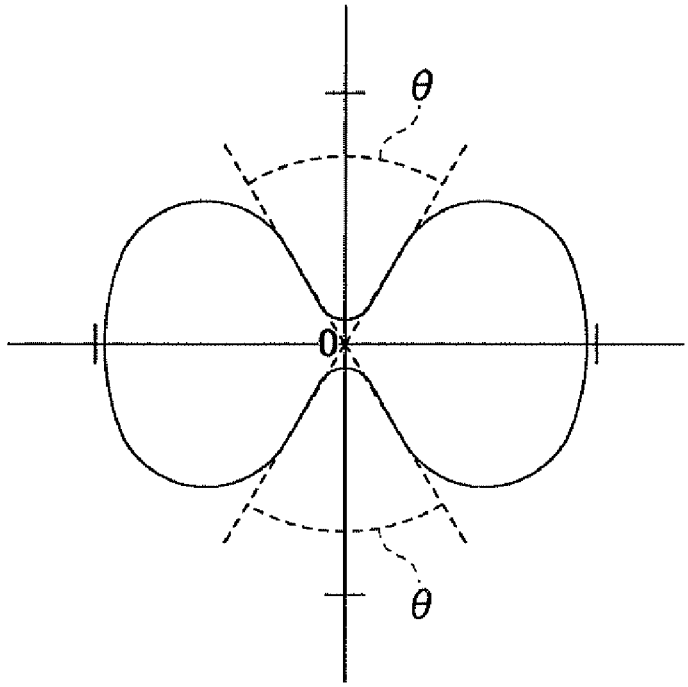
FIG. 4B is a graph showing directivity of an antenna apparatus according to the second embodiment.

FIG. 4A is a schematic drawing of the antenna element 21 according to the second embodiment shown in planar view. FIG. 4B is a graph showing directivity of the antenna apparatus 20 according to the second embodiment.

The nonconductive portions 21B are formed in areas respectively which are included in the surface of the molded inverted teardrop-shaped resin, and are disposed 180 degrees apart with respect to each other with regard to the central axis 1 in planar view.

Each of the nonconductive portions 21B is formed in an area defined by the central angle θ in the circle of the antenna element 21 in planar view, respectively.

The antenna apparatus 20 according to the second embodiment does not radiate an electrical wave from the nonconductive portions 21B, and does not receive an electrical wave from the nonconductive portions 21B, because the nonconductive portions 21B are not metal plated.

As shown FIG. 4B, the directivity is lower in the directions in which the nonconductive portions 21B are formed. The directivity shown in FIG. 4B is different from those of an antenna element which does not include the nonconductive portions 21B, e.g. a molded inverted teardrop-shaped resin of which a whole surface is metal plated.

As described above, the antenna apparatus 20 according to the second embodiment provides selectivity of communication direction by forming the nonconductive portions 21B. As shown in FIG. 4B, the antenna apparatus 20 provides an excellent directivity except for the direction in which the nonconductive portions 21B are formed.

As described above, the antenna apparatus 20 according to the second embodiment provides selectivity of communication direction by forming the nonconductive portions 21B. Thus, an influence exerted by the noise sources is greatly reduced by facing the nonconductive portions 21B toward the noise sources, and the antenna apparatus 20 provides a high quality UWB communication except for the directions in which the nonconductive portions 21B are formed.

In a case where the antenna apparatus 20 is disposed close to a wall, it is better not to radiate an electrical wave toward the wall, because a reflected wave from the wall causes decrease of sensitivity of the antenna apparatus 20. In this case, it is possible to reduce a reflected wave from the wall and to enhance a sensitivity of the antenna apparatus 20 by facing the nonconductive portions 21B toward the wall.

Although the nonconductive portions 21B formed in areas disposed 180 degrees apart to each other in planar view are described, locations of the respective areas may be selected depending on a circumstance where the antenna apparatus 20 is disposed.

The center angle θ of the respective areas in which the nonconductive portions 21B are formed respectively may be set to any value depending on a positional relationship between the antenna apparatus 20 and the noise sources.

Third Embodiment

Figure 5:
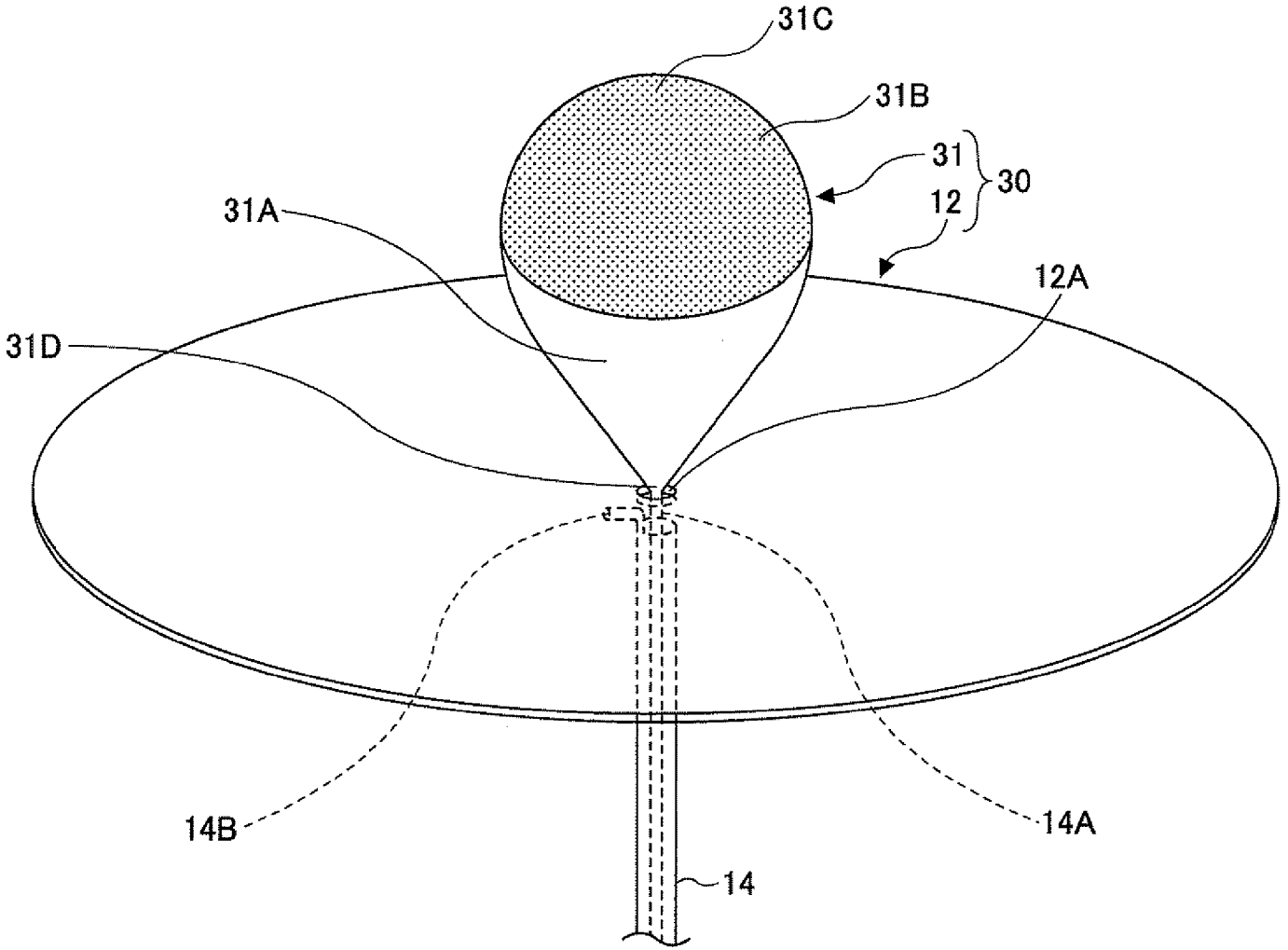
FIG. 5 is a schematic drawing of an antenna apparatus according to third embodiment shown in perspective view.

FIG. 5 is a schematic drawing of an antenna apparatus according to a third embodiment shown in perspective view. Hereinafter, the same elements as or similar elements to those of the antenna apparatus 10 according to the first embodiment are referred to by the same reference numerals, and a description thereof is omitted. An antenna apparatus 30 according to the third embodiment is different from the antenna apparatus 10 according to the first embodiment in that an antenna element 31 of the antenna apparatus 30 includes a metal layer 31A which is formed on a surface of a conical shaped portion of the molded inverted teardrop-shaped resin, a nonconductive portion 31B which comprises the surface of a hemispherical shaped portion of the molded inverted teardrop-shaped resin, a top portion 31C, and a feeding point 31D.

Since the antenna element 31 according to the third embodiment includes the metal layer 31A formed on the surface of the conical shaped portion, the antenna apparatus 30 provides uniform directivity in 360 degrees. The antenna apparatus 30 does not radiate an electrical wave upwardly, because the nonconductive portion 31B is not metal plated. The antenna apparatus 30 radiates an electrical wave mainly downwardly.

As described above, the antenna apparatus 30 according to the third embodiment provides selectivity of communication direction by forming the nonconductive portion 31B. Thus, an influence exerted by a noise source is greatly reduced by facing the nonconductive portion 31B toward the noise source, and the antenna apparatus 30 provides a high quality UWB communication except for the direction in which the nonconductive portion 31B is formed.

In a case where the antenna apparatus 30 is disposed close to a wall, it is better not to radiate an electrical wave toward the wall, because a reflected wave from the wall causes a decrease of sensitivity of the antenna apparatus 30. In this case, it is possible to reduce a reflected wave from the wall and to enhance a sensitivity of the antenna apparatus 30 by facing the nonconductive portion 31B toward the wall. The antenna apparatus 30 according to the third embodiment provides a high quality UWB communication.

Further, the present invention is not limited to these embodiments, but variations and modifications may be made without departing from the scope of the present invention.

The present application is based on Japanese Priority Application No. 2008-235021 filed on Sep. 12, 2008 with the Japanese Patent Office, the entire contents of which are hereby incorporated by reference.

What is claimed is:

1. An antenna apparatus comprising:

an antenna element having a teardrop shape and configured to be fed with electrical power from an external power source; and a ground element coupled to the antenna element, wherein the antenna element includes one or more nonconductive portions.

2. The antenna apparatus as claimed in claim 1, wherein the antenna element includes a teardrop-shaped resin member, and a surface of the teardrop-shaped resin member is metal plated except for an area corresponding to the one or more nonconductive portions.

3. The antenna apparatus as claimed in claim 1, wherein the one or more nonconductive portions is formed in an area bounded by two virtual planes configured to include a central axis of the teardrop shape and to intersect each other at the central axis.

4. The antenna apparatus as claimed in claim 1, wherein the antenna element includes a teardrop-shaped resin member, and wherein the one or more nonconductive portions is formed in a first surface of the teardrop-shaped resin member bounded by two virtual planes configured to include the central axis of the teardrop-shaped resin member and intersect at the central axis, and a second surface of the teardrop-shaped resin member corresponding to an area other than the one or more nonconductive portions is metal plated.

5. The antenna apparatus as claimed in claim 1, wherein the one or more nonconductive portions includes a hemispherical shaped portion of the teardrop shape.

6. The antenna apparatus as claimed in claim 1, wherein the antenna element includes a teardrop-shaped resin member, and a surface of the teardrop-shaped resin member is metal plated except for an area corresponding to the one or more nonconductive portions, and wherein the one or more nonconductive portions includes a hemispherical shaped portion of the teardrop-shaped resin member.

7. The antenna apparatus as claimed in claim 1, wherein the antenna element includes a teardrop-shaped resin member, and the one or more nonconductive portions is formed by a mask process when the teardrop-shaped resin member is metal plated.

* * * * *